US009550958B2

(12) United States Patent
Marsh et al.

(10) Patent No.: US 9,550,958 B2
(45) **Date of Patent: *Jan. 24, 2017**

(54) PHENATE DETERGENT PREPARATION

(71) Applicant: Infineum International Limited, Abingdon (GB)

(72) Inventors: Adam P. Marsh, Witney (GB); Dirk Schwaebisch, Oxford (GB); Oliver J. Delamore, Abingdon (GB)

(73) Assignee: INFINEUM INTERNATIONAL LIMITED (GB)

( * ) Notice: Subject to any disclaimer, the term of this patent is extended or adjusted under 35 U.S.C. 154(b) by 370 days.

This patent is subject to a terminal disclaimer.

(21) Appl. No.: 13/916,608

(22) Filed: Jun. 13, 2013

(65) Prior Publication Data

US 2014/0371120 A1 Dec. 18, 2014

(30) Foreign Application Priority Data

Jun. 13, 2012 (EP) ..... 12171747

(51) Int. Cl.
*C10M 159/22* (2006.01)
*C10M 141/12* (2006.01)

(52) U.S. Cl.
CPC ..... *C10M 141/12* (2013.01); *C10M 159/22* (2013.01); *C10M 2219/087* (2013.01); *C10M 2219/088* (2013.01); *C10M 2219/089* (2013.01)

(58) Field of Classification Search
CPC ..... C10M 159/22; C10M 2219/087; C10M 2219/088; C10M 2219/089
USPC ..... 508/574
See application file for complete search history.

(56) References Cited

U.S. PATENT DOCUMENTS

| | | | | |
|---|---|---|---|---|
| 5,069,804 | A * | 12/1991 | Marsh et al. | 508/460 |
| 5,716,914 | A * | 2/1998 | Cane et al. | 508/460 |
| 5,910,468 | A | 6/1999 | Dohhen et al. | |
| 6,339,052 | B1 * | 1/2002 | Dohhen et al. | 508/436 |
| 6,551,965 | B2 * | 4/2003 | Nagamatsu et al. | 508/192 |
| 8,198,225 | B2 * | 6/2012 | Harrison et al. | 508/572 |
| 8,702,968 | B2 * | 4/2014 | Boons | 208/19 |
| 2014/0128301 | A1 * | 5/2014 | Glass et al. | 508/306 |
| 2014/0130757 | A1 * | 5/2014 | Marsh et al. | 123/1 A |
| 2014/0130758 | A1 * | 5/2014 | Marsh et al. | 123/1 A |
| 2014/0287969 | A1 * | 9/2014 | Jukes | 508/332 |

FOREIGN PATENT DOCUMENTS

| | | | |
|---|---|---|---|
| EP | 0094814 | A2 | 11/1983 |
| EP | 1903093 | A1 | 3/2008 |

* cited by examiner

*Primary Examiner* — Ellen McAvoy

(57) ABSTRACT

A sulphurised calcium phenate detergent is made by (i) reacting hydrogenated distlled CNSL with a calcium salt and sulphur in the presence of a promoter and process solvent; (ii) reacting the product of (i) with additional calcium salt and promoter, and with a co-surfactant, and then carbonating; and optionally (iii) further carbonating the reaction mixture to obtain overbased sulphurised calcium phenate.

12 Claims, No Drawings

PHENATE DETERGENT PREPARATION

FIELD OF THE INVENTION

This invention relates to making a sulphurised calcium alkyl phenate detergent and to use of the detergent in internal combustion engine lubrication.

BACKGROUND OF THE INVENTION

Sulphurised calcium alkyl phenate detergents are well known additive components for internal combustion engine crankcase lubricating oil compositions. However, certain alkylphenol sources (nonylphenol, tetrapropenylphenol) used in their manufacture are classified as reproductive toxins; accordingly, there is a desire to identify other phenol sources.

The art describes a way of meeting this problem. Thus, U.S. Pat. No. 5,910,468 ('468) describes the preparation of sulphurised calcium alkyl phenate from, as the phenol source, distilled or hydrogenated-distilled cashew nut shell liquid (CNSL). Distilled CNSL is a mixture of biodegradable meta-hydrocarbyl substituted phenols, where the hydrocarbyl group is linear and unsaturated, including cardanol. Catalytic hydrogenation of distilled CNSL gives rise to a mixture of meta-hydrocarbyl substituted phenols, predominantly rich in 3-pentadecylphenol.

A problem with the process described in '468 is that the sulphurised calcium alkyl phenate detergents thereby produced lack satisfactory deposit control performance.

SUMMARY OF THE INVENTION

The above problem is met according to the invention by using hydrogenated distilled CNSL as the phenol source and by employing a co-surfactant in one or more process steps to make a phenate detergent. '468 does not describe employing a co-surfactant.

The invention provides, in a first aspect, a method of making a sulphurised calcium phenate detergent comprising the steps of (i) reacting one or more alkyl phenol materials comprising hydrogenated distilled cashew nut shell liquid with a calcium salt (such as calcium oxide or calcium hydroxide) and sulphur in the presence of a promoter (such as a mono-, di- or multibasic alcohol, preferably a 1,2-vicinal diol) and of a process solvent (such as but not limited to isodecanol or 2-ethylhexanol) to obtain a reaction mixture; (ii) reacting the reaction mixture with additional calcium salt and promoter, and with a co-surfactant, and then subjecting the reaction mixture to carbonation; and optionally (iii) further carbonating the reaction mixture to obtain overbased sulphurised calcium phenate; wherein the co-surfactant is selected from a phenol or alkyl phenol or methylene bridged alkyl phenol; a hydrocarbyl substituted anhydride or succinic anhydride (e.g. polyisobutene succinic anhydride).

The invention provides, in a second aspect, the use of a co-surfactant in a detergent of the first aspect of the invention as an additive in a lubricating oil composition for improving the oxidation stability and deposit control properties of the composition in comparison with those of an analogous composition that lacks the co-surfactant; wherein the co-surfactant is selected from a phenol or alkyl phenol or methylene bridged alkyl phenol; or a hydrocarbyl substituted anhydride or succinic anhydride (e.g. polyisobutene succinic anhydride).

The invention provides, in a third aspect, a lubricating oil composition comprising, in a major amount, an oil of lubricating viscosity and, in a minor amount, a detergent of the first aspect of the invention.

The invention provides, in a fourth aspect, a method of operating an internal combustion engine comprising fuelling the engine and lubricating the engine with the lubricating oil composition of the third aspect of the invention.

In this specification, the following words and expressions, if and when used, have the meanings ascribed below:

"Active ingredients" or "(a.i.)" refers to additive material that is not diluent or solvent;

"comprising" or any cognate word specifies the presence of stated features, steps, or integers or components, but does not preclude the presence or addition of one or more other features, steps, integers, components or groups thereof; the expressions "consists of" or "consists essentially of" or cognates may be embraced within "comprises" or cognates, wherein "consists essentially of" permits inclusion of substances not materially affecting the characteristics of the composition to which it applies;

"major amount" means 50 mass % or more of a composition;

"minor amount" means less than 50 mass % of a composition;

"TBN" means total base number as measured by ASTM D2896.

Furthermore in this specification, if and when used:

"calcium content" is as measured by ASTM D4951;

"phosphorus content" is as measured by ASTM D5185;

"sulphated ash content" is as measured by ASTM D874;

"sulphur content" is as measured by ASTM D2622;

"KV 100" means kinematic viscosity at 100° C. as measured by ASTM D445.

Also, it will be understood that various components used, essential as well as optimal and customary, may react under conditions of formulation, storage or use and that the invention also provides the product obtainable or obtained as a result of any such reaction.

Further, it is understood that any upper and lower quantity, range and ratio limits set forth herein may be independently combined.

DETAILED DESCRIPTION OF THE INVENTION

Method

In the method of the invention, note may be made of the following:

Step (i)

A characteristic structural feature of the alkyl phenol materials used in the invention is meta hydrocarbyl-substitution of the aromatic ring where the substituent is attached to the ring at its first (C1) carbon atom. This structural feature is not available by chemical alkyl phenol synthesis such as the Friedel-Crafts reaction of phenol with olefins. The latter typically gives mixtures of ortho and para alkyl phenols (but only around 1% of meta alkyl phenols), and where attachment of the alkyl group to the aromatic ring is at the second (C2) or higher carbon atom.

Cardanol, the product obtained by distilling technical CNSL, typically contains 3-pentadecylphenol (3%); 3-(8-pentadecenyl) phenol (34-36%); 3-(8,11-pentadecadienyl) phenol (21-22%); and 3-(8,11,14-pentadecatrienyl) phenol (40-41%), plus a small amount of 5-(pentadecyl) resorcinol (c. 10%), also referred to as cardol. Technical CNSL contains mainly cardanol plus some polymerized material.

Cardanol may therefore be expressed as containing significant amounts of meta-linear hydrocarbyl substituted phenol, where the hydrocarbyl group has the formula $C_{15}H_{25-31}$ and is attached to the aromatic ring at its first carbon atom (C1).

Thus, both cardanol and technical CNSL contain significant quantities of material having long linear unsaturated side chains and only small quantities of material with long linear saturated side chains. The present invention employs material where a major proportion, preferably all of the phenol, contains material with long linear saturated side chains. Such latter material is obtainable by hydrogenating cardanol; a preferred example is 3-(pentadecyl) phenol, where the pentadecyl group is linear and is attached to the aromatic ring at its first carbon atom. It may constitute 50 or more, 60 or more, 70 or more, 80 or more, or 90 or more, mass % of the additive of the invention. It may contain small quantities of 3-(pentadecyl) resorcinol. The invention does not include technical CNSL.

Step (ii)

The co-surfactant may be a phenol or alkyl phenol or methylene bridged alkyl phenol; or a hydrocarbyl substituted anhydride or succinic anhydride (e.g. polyisobutene succinic anhydride).

The alkyl phenol may include one or more chains (preferably one chain) each having from 4 to 100 carbon atoms, preferably from 8 to 50 carbon atoms, more preferably 8 to 36 carbon atoms, and even more preferably 10 to 24, and most preferably 12 to 20 carbon atoms.

The methylene bridged alkyl phenol may be di-phenolic, tri-phenolic, tetra-phenolic, penta-phenolic, hexa-phenolic, hepta-phenolic, octa-phenolic, nona-phenolic or larger. The methylene bridged alkyl phenol is preferably hepta-phenolic.

The hydrocarbyl substituted anhydride or succinic anhydride preferably has a molecular weight of between 200 and 5000, more preferably between 400 and 2000, more preferably 450 to 1000, more preferably 500 to 900, most preferably 500 to 800.

The co-surfactant may be present in the range of 1-20, such as 4-12, such as 4-10, such as 4-8, preferably 6-8, mass % based on the total mass of surfactant.

Provision of the co-surfactant in step (ii) avoids the possibility of its adverse interaction with elemental sulphur in step (i).

Lubricating Oil Composition

An oil of lubricating viscosity provides a major proportion of the composition and may be any oil suitable for lubricating an internal combustion engine.

It may range in viscosity from light distillate mineral oils to heavy lubricating oils. Generally, the viscosity of the oil ranges from 2 to 40 $mm^2$/sec, as measured at 100° C.

Natural oils include animal oils and vegetable oils (e.g., castor oil, lard oil); liquid petroleum oils and hydrorefined, solvent-treated or acid-treated mineral oils of the paraffinic, naphthenic and mixed paraffinic-naphthenic types. Oils of lubricating viscosity derived from coal or shale also serve as useful base oils.

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes)); alkybenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulphides and derivative, analogues and homologues thereof.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, and the alkyl and aryl ethers of polyoxyalkylene polymers (e.g., methyl-polyiso-propylene glycol ether having a molecular weight of 1000 or diphenyl ether of poly-ethylene glycol having a molecular weight of 1000 to 1500); and mono- and polycarboxylic esters thereof, for example, the acetic acid esters, mixed C3-C8 fatty acid esters and C13 oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of such esters includes dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from C5 to C12 monocarboxylic acids and polyols and polyol esters such as neopentyl glycol, trimethylolpropane, pentaerythritol, dipentaerythritol and tripentaerythritol.

Silicon-based oils such as the polyalkyl-, polyaryl-, polyalkoxy- or polyaryloxysilicone oils and silicate oils comprise another useful class of synthetic lubricants; such oils include tetraethyl silicate, tetraisopropyl silicate, tetra-(2-ethylhexyl)silicate, tetra-(4-methyl-2-ethylhexyl)silicate, tetra-(p-tert-butyl-phenyl) silicate, hexa-(4-methyl-2-ethylhexyl)disiloxane, poly(methyl)siloxanes and poly(methylphenyl)siloxanes. Other synthetic lubricating oils include liquid esters of phosphorus-containing acids (e.g., tricresyl phosphate, trioctyl phosphate, diethyl ester of decylphosphonic acid) and polymeric tetrahydrofurans.

Unrefined, refined and re-refined oils can be used in lubricants of the present invention. Unrefined oils are those obtained directly from a natural or synthetic source without further purification treatment. For example, a shale oil obtained directly from retorting operations; petroleum oil obtained directly from distillation; or ester oil obtained directly from esterification and used without further treatment, are unrefined oils. Refined oils are similar to unrefined oils except that the oil is further treated in one or more purification steps to improve one or more properties. Many such purification techniques, such as distillation, solvent extraction, acid or base extraction, filtration and percolation, are known to those skilled in the art. Re-refined oils are obtained by processes similar to those used to provide refined oils but begin with oil that has already been used in service. Such re-refined oils are also known as reclaimed or reprocessed oils and are often subjected to additional processing using techniques for removing spent additives and oil breakdown products.

The American Petroleum Institute (API) publication "Engine Oil Licensing and Certification System", Industry Services Department, Fourteenth Edition, December 1996, Addendum 1, December 1998 categorizes groups of base stocks. As an example of an oil of lubricating viscosity that may be used in a lubricating oil composition of the present invention, there may be mentioned an oil containing 50 mass % or more of a basestock containing greater than or equal to 90% saturates and less than or equal to 0.03% sulphur or a mixture thereof. Preferably, it contains 60, such as 70, 80 or 90, mass % or more of said basestock or a mixture thereof. The oil of lubricating viscosity may consist or substantially consist of said basestock or a mixture thereof.

Oil of lubricating viscosity may provide 50 mass % or more of the composition. Preferably, it provides 60, such as 70, 80 or 90, mass % or more of the composition.

The lubricating oil composition may, for example, be a marine diesel cylinder lubricant ("MDCL") or a trunk piston engine oil ("TPEO").

Engines

The phenates of the invention may be used in lubricants for a range of internal combustion engines (spark-ignited or compression ignited) such as motor vehicle engines and marine engines. Of the latter, there may be mentioned two-stroke marine diesel cross-head engines and marine trunk piston engines.

EXAMPLES

The present invention is illustrated by but in no way limited to the following examples.

Preparation of Calcium Phenate Detergent

The general process was as follows:

Step (i)

Hydrogenated distilled CNSL (ex Sigma Aldrich, Cardolite Corporation or synthesized from cardanol sourced from various providers) is sulphurised using elemental sulphur (added in one or two steps) in the presence of calcium oxide, solvent and ethylene glycol.

Step (ii)

Further ethylene glycol, calcium oxide (such as to provide the required TBN), a co-surfactant and $CO_2$ are added to the reaction mixture of step (i).

The synthesis is completed by vacuum distillation, filtration or centrifugation, and, if necessary, dilution in oil.

The process used was as follow:

- Preheated hydrogenated distilled CNSL, isodecanol (reaction solvent), base oil (reaction solvent and diluent), an antifoam agent, elemental sulphur (added at 50° C.) and CaO (calcium oxide) were charged to the reactor.
- This was heated up to 140° C. in 30 minutes with stirring throughout.
- EG (ethylene glycol—reaction promotor and solvent) was added drop wise at 140° C.
- Heating was continued up to 175° C. and held for 2 hours.
- Co-surfactant and additional CaO and EG were charged.
- Water was removed in 25 minutes.
- $CO_2$ was added at 175° C. over between 2 and 6 hours.
- The reaction mixture was heated up to 210° C. and vacuum applied to remove reaction solvents The product was filtered and diluted to required TBN with base oil if necessary.

A set of calcium phenate detergents was prepared employing various co-surfactants. As a comparison, a calcium phenate detergent was prepared where no co-surfactant was used.

Tests

The above calcium phenate detergents, together with a calcium phenate detergent made according to '468, were blended into identical marine lubricant formulations (each to contain 9.125 mass % of the detergent), which were subjected to the following tests.

Panel Coker Test

Lubricating oils may degrade on hot engine surfaces and leave deposits which will affect engine performance; the panel coker test simulates typical conditions and measures the tendency of oils to form such deposits. The oil under test is splashed onto a heated metal plate by spinning a metal comb-like splasher device within a sump containing the oil. At the end of the test period deposits formed may be assessed by 'rating' of the plate's appearance.

An overview of the test method is as follows:

- 225 ml of the oil is heated in an oil bath to 100° C.
- A heated aluminium panel is located above the oil bath at an incline, maintained at a temperature of 320° C.
- The oil is splashed for 15 seconds against this panel, followed by no splashing for 45 seconds.
- This cycle of intermittent splashing is continued for 1 hour.
- The panel is then rated for discolouration.

The rating is measured, by a system involving a computer-controlled photographic device (a "Cotateur"). The program looks at both the degree of discolouration and area covered in order to offer a rating between 0 and 10.

A higher value indicates better performance.

Results are set out in the table below.

| Example | Co-surfactant | Rating |
|---|---|---|
| 1 (comparative) | Stearic Acid | 6.52 |
| 2 (comparative) | Oleic Acid | 6.69 |
| 3 (comparative) | Lauric Acid | 7.06 |
| 4 (comparative) | Sulphonic acid | 8.18 |
| 5 | Polyisobutene succinic anhydride ("PIBSA") | 8.85 |
| 6 | Alkylphenol | 8.80 |
| A (comparative) | — | 7.05 |
| '468 (comparative) | — | 4.93 |

Each of Examples 1-6 contained about 8 mass % co-surfactant compared with the mass of sulphurised alkylphenol soap.

Example A was made by the same process as Examples 1-6 but without using a co-surfactant.

Example '468 was made by the process described in Example 1 of '468 (i.e. U.S. Pat. No. 5,910,468).

The results demonstrate that the use of PIBSA or alkylphenol as co-surfactants provides noticeably improved deposit control in comparison with the other comparative examples.

Stability

Storage stability, in both additive packages and oils, was measured over a 12 week period, at ambient (room) temperature and at 60° C. The formulation used was a commercial marine MDCL formulation), where the phenate compounds were treated at 14.17%.

The results of this are set out in the table below.

Additive Package

| Ex | Co-Surfactant | KV100 Viscosity increase (%) Ambient | KV100 Viscosity increase (%) 60° C. | Stability Observation Ambient | Stability Observation 60° C. |
|---|---|---|---|---|---|
| 1 | Stearic acid | 6.8 | 27.2 | Viscous, black, opaque, no sediment | Black, opaque, no visible sediment |
| 5 | PIBSA | −3.6 | 7.4 | Viscous, black, opaque, no sediment | Black, opaque, no visible sediment |
| A | | 4.3 | | Viscous, black, opaque, no sediment | Black, opaque, no visible sediment |
| '468 | | 2.6 | 41.5 | Viscous, black, opaque, no sediment | Light, brown, hazy |

The Table above shows that viscosity increase at 60° C. is reduced when the overbased phenate is prepared using PIBSA as a co-surfactant.

What is claimed is:

1. A method of making a sulphurised calcium phenate detergent comprising the steps of (i) reacting one or more alkyl phenol materials comprising hydrogenated distilled cashew nut shell liquid with a calcium salt and sulphur in the presence of a promoter and of a process solvent to obtain a reaction mixture;

(ii) reacting the reaction mixture with additional amounts of calcium salt and promoter, and with a co-surfactant, and then subjecting the reaction mixture to carbonation; and optionally (iii) further carbonating the reaction mixture to obtain overbased sulphurised calcium phenate;

wherein the co-surfactant is selected from a phenol or alkyl phenol or methylene bridged alkyl phenol; or a hydrocarbyl substituted anhydride or succinic anhydride.

2. The method of claim 1, where the co-surfactant is present in the range of 1-20 mass %, based on the total mass of surfactant.

3. The method of claim 1, where the co-surfactant is a polyisobutene succinic anhydride.

4. The method of claim 3, wherein the co-surfactant is a polyisobutene succinic anhydride having a molecular weight of between 200 and 5000.

5. The method of claim 1, where the alkylphenol material in (i) comprises 3-pentadecylphenol.

6. A sulphurised calcium phenate detergent obtained by the method of claim 1.

7. A method for improving the oxidation stability and deposit control properties of a lubricating oil composition comprising the addition of a co-surfactant selected from a phenol, an alkyl phenol, a methylene bridged alkyl phenol, or a hydrocarbyl substituted anhydride or succinic anhydride in a detergent of claim 5, and adding such a detergent, as an additive, to said lubricating oil composition.

8. A lubricating oil composition comprising, in a major amount, an oil of lubricating viscosity and, in a minor amount, a detergent of claim 5.

9. The lubricating oil composition of claim 8, where the oil of lubricating viscosity contains 50 mass % or more of a basestock containing greater than or equal to 90% saturates and less than or equal to 0.03% sulphur or a mixture thereof.

10. The lubricating oil composition of claim 8, comprising a marine diesel cylinder lubricant.

11. The lubricating oil composition of claim 8, comprising a trunk piston engine oil.

12. A method of operating an internal combustion engine comprising fuelling the engine and lubricating the engine with the lubricating oil composition of claim 8.

* * * * *